US012565376B2

(12) United States Patent
Wassink

(10) Patent No.: US 12,565,376 B2
(45) Date of Patent: Mar. 3, 2026

(54) METHOD FOR SETTING UP A SILO

(71) Applicant: Top-Siloconstructions B.V., Aalten (NL)

(72) Inventor: Herman Hendrik Johan Wassink, Aalten (NL)

(73) Assignee: Top-Siloconstructions B.V., Aalten (NL)

( * ) Notice: Subject to any disclaimer, the term of this patent is extended or adjusted under 35 U.S.C. 154(b) by 202 days.

(21) Appl. No.: 18/214,073

(22) Filed: Jun. 26, 2023

(65) Prior Publication Data

US 2023/0415977 A1 Dec. 28, 2023

(30) Foreign Application Priority Data

Jun. 27, 2022 (NL) ..... 2032285

(51) Int. Cl.

| | |
|---|---|
| ***B65D 88/28*** | (2006.01) |
| ***B65D 90/14*** | (2006.01) |
| ***E04H 7/22*** | (2006.01) |
| ***E04H 7/30*** | (2006.01) |
| *B65D 88/32* | (2006.01) |

(52) U.S. Cl.

CPC ..... *B65D 88/28* (2013.01); *B65D 90/14* (2013.01); *E04H 7/22* (2013.01); *E04H 7/30* (2013.01); *B65D 88/32* (2013.01); *E04H 2007/225* (2013.01)

(58) Field of Classification Search

CPC ..... B65D 88/28; B65D 90/14; B65D 88/32; E04H 7/22; E04H 7/30; E04H 2007/225

USPC ..... 52/197, 192, 194

See application file for complete search history.

(56) References Cited

U.S. PATENT DOCUMENTS 1,449,232 A * 3/1923 Knapp ..... B65D 88/32 52/29
3,327,870 A 6/1967 Fairchild, Jr.
RE30,108 E * 10/1979 Oliver ..... E04C 2/384 52/192
4,893,445 A * 1/1990 Hefer ..... E04C 2/08 52/234

(Continued)

FOREIGN PATENT DOCUMENTS

DE 202006003886 U1 6/2006

*Primary Examiner* — Brent W Herring
(74) *Attorney, Agent, or Firm* — The Webb Law Firm

(57) ABSTRACT

Provided is a silo hopper with a hopper opening for connection to a silo cell with a rectangular cross-section. The silo hopper includes a hopper wall which encloses the hopper opening. The hopper wall extends from an upper plane to a lower plane lying parallel thereto and tapers from a rectangular upper cross-section in the upper plane to a smaller lower cross-section in the lower plane. The silo hopper is self-supporting and is provided at at least one corner, preferably at all corners, with a leg segment. The leg segment extends at right angles to the upper plane and includes a first plate part which is parallel to a first side of the upper cross-section and includes a second plate part which is parallel to a second side of the upper cross-section lying at right angles to the first side. The first and second plate parts are mutually connected close to the hopper opening by a third plate part. The third plate part forms an angle of 135° with the first and second plate part, as seen perpendicularly of the upper plane. Also provided are a silo base and a method for erecting a silo.

4 Claims, 1 Drawing Sheet

(56) References Cited

U.S. PATENT DOCUMENTS 5,005,327 A * 4/1991 Becker ..... B65D 90/08
52/192
9,434,533 B2 9/2016 Lucas

* cited by examiner

METHOD FOR SETTING UP A SILO

CROSS REFERENCE TO RELATED APPLICATION

This application claims priority to The Netherlands Patent Application No. 2032285, filed Jun. 27, 2022, the disclosure of which is hereby incorporated by reference in its entirety.

BACKGROUND OF THE INVENTION

Field of the Invention

The invention relates to a silo hopper for connection to a silo cell with a rectangular cross-section, which silo hopper comprises a hopper opening with a hopper wall which encloses the hopper opening, which hopper wall extends from an upper plane to a lower plane lying parallel thereto and tapers from a rectangular upper cross-section in the upper plane to a smaller lower cross-section in the lower plane.

In a second aspect the invention also relates to a silo base with at least one silo hopper according to the invention. In a third aspect the invention also relates to a method for erecting a silo with a silo hopper according to the invention.

Description of Related Art

Known silo hoppers are widely used in the construction of silos with rectangular or square silo cells, which are widely used for storage of dry bulk material. The hoppers, also referred to as funnels, are here a significant factor in the outflow characteristic of a silo.

The known silos have a modular construction, wherein the different components such as the bearing steel structure, the hoppers and the silo cells must be mutually connected. For this purpose a great deal of specialized welding work is carried out on site during construction of the silos, particularly to connect the silo hopper to the silo cell. The welding work must here also take place in places which are difficult to reach.

SUMMARY OF THE INVENTION

It is now an object of the invention to reduce or even obviate the above stated drawbacks.

This object is achieved according to the invention with a silo hopper, characterized in that the silo hopper is self-supporting and is provided at at least one corner, preferably at all corners, with a leg segment, which leg segment extends at right angles to the upper plane and comprises a first plate part which is parallel to a first side of the upper cross-section and comprises a second plate part which is parallel to a second side of the upper cross-section lying at right angles to the first side, which first and second plate part are mutually connected close to the hopper opening by a third plate part, which third plate part forms an angle of 135° with the first and second plate part, as seen perpendicularly of the upper plane.

With a silo hopper according to the invention a stable base is provided for constructing a silo with rectangular silo cells, wherein the precision welding can already be completed in the factory and a self-supporting hopper is obtained which can function as structural component of the silo. By providing the silo hopper with leg segments and embodying these segments as a quarter segment of an equiangular octagon by means of the construction from three plate parts, adjacent silo hoppers can be structurally connected to each other in simple manner by mutually connecting them to an octagonal bushing. Owing to the construction of the leg segments the precision of the mutual alignment of the silo cells needed for the final height of the silos can also be achieved in an assembly of many silo hoppers.

In another embodiment of a silo hopper according to the invention a tongue with bolt holes is provided on the upper edge of the hopper wall for the purpose of attaching the silo hopper to the walls of a silo cell by means of bolt connections.

By arranging a tongue provided with bolt holes along the upper edge of the hopper wall the silo hopper can be attached to the walls of a silo cell in simple manner by means of a bolt connection, without in situ welding having to take place for this purpose.

In a preferred embodiment of a silo hopper according to the invention the at least one leg segment, preferably each of the plate parts of the at least one leg segment, is provided with bolt holes for attaching the at least one leg segment to a support structure of a silo by means of bolt connections.

By providing bolt holes in the leg segments the structural connection to a support structure of the silo, such as for instance an octagonal bushing, can be obtained in simple manner by means of bolt connections. Welding work is hereby rendered unnecessary. When the third plate part of the leg segment is provided with bolt holes, the bolt connection can be made from the silo hopper in simple manner. All plate parts can optionally be provided with bolt holes.

In a second aspect the invention also relates to a silo base with at least one silo hopper according to the invention, which silo base also comprises at least one octagonal bushing, each of the internal angles of which is 135°, wherein each of the leg segments of the at least one silo hopper is structurally connected to a respective octagonal bushing.

Structurally connecting each of the leg segments of the at least one silo hopper to a respective octagonal bushing forms a silo base which forms a structural whole. The silo cell walls can be constructed thereon.

In a third aspect the invention also relates to a method for erecting a silo, comprising the steps of:

- providing at least one silo hopper according to the invention;
- providing an octagonal bushing, each of the internal angles of which is 135°;
- forming at least a part of an octagon by means of 1-4 adjacent leg segments;
- structurally connecting the adjacent leg segments to each other by connecting each of the leg segments to the bushing.

By erecting a silo according to the method no welding work need be carried out on site. Not only is a traditional welded connection thus replaced by a bolted connection in the method, the silo hopper is also used as structural base for the construction of the silo cell. In order to enable this construction use is made of the leg segments which are coupled to an octagonal bushing. The construction of the leg segments also enables adjacent silo cells to be structurally coupled to each other. When the structural couplings are obtained exclusively by means of bolt connections, the resulting silo is also fully dismantlable.

Another embodiment of a method for erecting a silo according to the invention is a method with at least one silo hopper, at least one leg segment of which, preferably each of the plate parts of the at least one leg segment of which, is provided with bolt holes, wherein the bushing is also characterized in that it is provided with bolt holes corresponding with the bolt holes of the adjacent leg segments and wherein the leg segments are substantially, preferably exclusively structurally connected to each other by means of bolt connections arranged through the corresponding bolt holes.

It is a great advantage of the method according to the invention that the need for in situ welding when erecting a silo is eliminated. It is therefore desirable for the mutual structural connection of the silo base formed by the silo hoppers to be obtained substantially by the bolt connections. Substantially is understood to mean that an optional weld connection is not required for the purpose of obtaining the structural mutual coupling required for the construction. The greatest advantage is therefore gained according to the invention when the structural coupling is obtained exclusively with bolt connections.

In a preferred embodiment of a method for erecting a silo according to the invention the method also comprises the steps of:

providing at least one silo cell wall part;

arranging the at least one silo cell wall part on the at least one silo hopper connected to the bushing;

mutually structurally connecting the at least one silo cell wall part to the bushing, preferably substantially, more preferably exclusively by means of at least one bolt connection.

Because a solid base is formed by the silo hopper, the silo cell can be constructed directly onto the silo hopper. The silo cell wall parts are here also connected directly to the octagonal bushing. After the silo hoppers have been connected to the bushing, the bushing still protrudes sufficiently above the formed silo base for the purpose of structurally coupling to an adjacent silo cell wall part.

According to the invention, the mutual structural connection of the silo cell walls to the bushing is then preferably also obtained substantially and preferably exclusively by means of a bolt connection.

In addition to the silo hopper and the method according to the invention, it is advantageous to offer a kit for application of a method according to the invention, this kit being assembled from the parts needed to construct a silo according to the invention.

BRIEF DESCRIPTION OF THE DRAWINGS

These and other features of the invention are further elucidated with reference to the accompanying figures.

DESCRIPTION OF THE INVENTION

Figure 1:
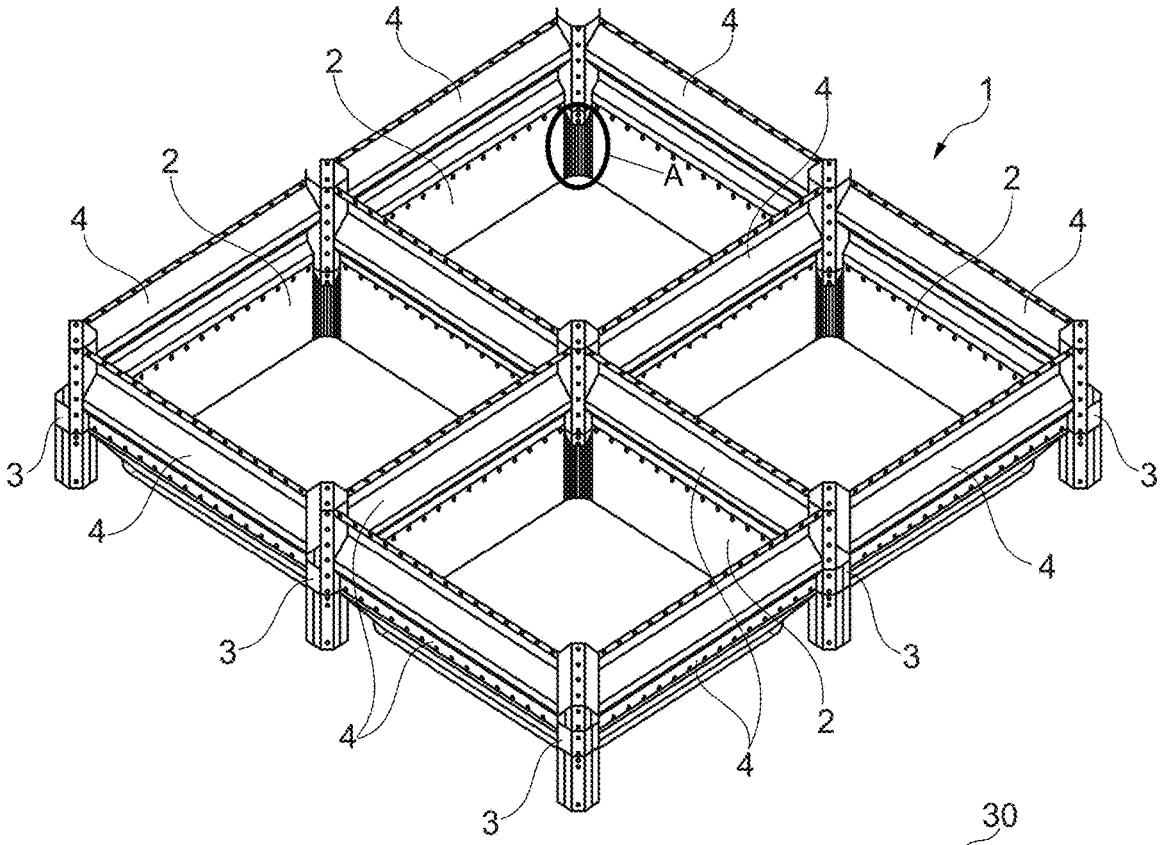
FIG. 1 shows a silo according to the invention in perspective view.

FIG. 1 shows a perspective view of a silo 1 according to the invention. The silo 1 has silo base formed by four silo hoppers 2. The silo hoppers 2 are mutually connected by means of octagonal bushings 3 arranged at the junctions of the leg segments. Silo cell walls 4 of the sheet piling type are arranged on the silo hoppers 2 for the purpose of forming the silo cell wall.

Figure 2:
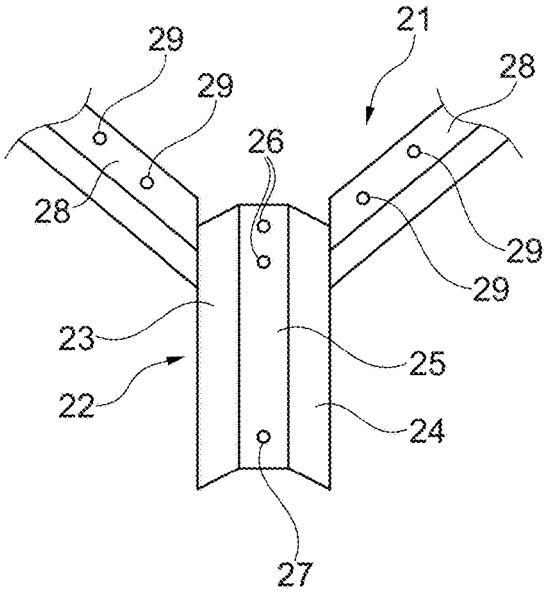
FIG. 2 shows a detail of a front view of leg segment indicated at circle A of FIG. 1 of a silo hopper according to the invention.

FIG. 2 shows a detail of a silo hopper 21, in which is visible a leg segment 22 which is constructed from a first 23, second 24 and third 25 plate part. The adjacent plate parts 23, 24, 25 have a mutual angle of 135° and therefore form a quarter of an equiangular octagon. Provided in the third plate part 25 are bolt holes 26 for coupling to an octagonal bushing. Also provided is a bolt hole 27 for coupling the leg segment 22 to an underlying structure. Provided on the upper edge of the hopper opening is a lip 28 provided with bolt holes 29, whereby a structural coupling to silo cell walls can be formed by means of a bolt connection.

Figure 3:
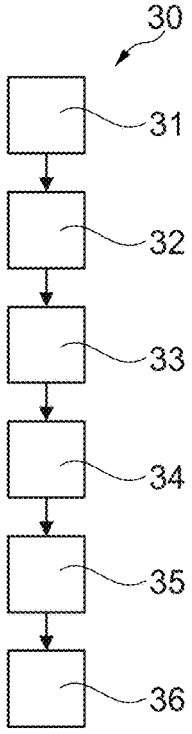
FIG. 3 shows a flow diagram of an embodiment of a method for erecting a silo according to the invention.

FIG. 3 shows a flow diagram 30 of a method for erecting a silo according to the invention. In a first step 31 at least one silo hopper is provided. In a second step 32 an octagonal bushing is provided, each of the internal angles of which is 135°. In a subsequent step 33 at least a part of an octagon is formed by means of 1-4 adjacent leg segments, wherein in the subsequent step 34 the adjacent leg segments are structurally connected to each other with the bushing. A silo base according to the invention is hereby obtained. In a possible further step 35 at least one silo cell wall part can additionally be provided. In the subsequent step 36 the at least one silo cell wall part is structurally connected to the bushing for the purpose of obtaining a silo according to the invention.

The invention claimed is:

1. A method for erecting a silo, comprising the steps of:

providing at least one silo hopper for connection to a silo cell with a rectangular cross-section, which silo hopper comprises a hopper opening with a hopper wall which encloses the hopper opening, which hopper wall extends from a rectangular upper cross-section to a smaller lower cross-section, wherein the silo hopper is self-supporting and is provided at at least one corner with a leg segment, which leg segment extends at right angles to the upper cross-section and lower cross-section and comprises a first plate part which is parallel to a first side of the upper cross-section and comprises a second plate part which is parallel to a second side of the upper cross-section lying at right angles to the first side, which first and second plate part are mutually connected close to the hopper opening by a third plate part positioned between the first plate part and the second plate part, and which third plate part forms an angle of 135° with the first plate part and the second plate part, wherein the hopper further comprises an octagonal bushing, each internal angle of the bushing being 135°, wherein the bushing is connected to the leg segment and comprises bolt holes configured to structurally connect adjacent leg segments of one or more other silo hoppers;

forming at least a part of an octagon by means of 1 to 4 of the adjacent leg segments; and structurally connecting the adjacent leg segments to each other by connecting each of the leg segments to the bushing by means of bolt connections arranged through the bolt holes and corresponding bolt holes of each of the adjacent leg segments;

providing at least one silo cell wall part;

arranging the at least one silo cell wall part on the at least one silo hopper connected to the bushing; and mutually structurally connecting the at least one silo cell wall part to the bushing.

2. The method of claim 1, wherein a tongue with bolt holes is provided on the upper edge of the hopper wall for the purpose of attaching the silo hopper to the walls of a silo cell by means of bolt connections.

3. The method of claim 1, wherein the leg segment provided at at least one corner of the at least one silo hopper is provided with bolt holes for attaching the at least one leg segment to a support structure of a silo by means of bolt connections.

4. The method of claim 1, further comprising the step of providing a silo base with the at least one silo hopper, wherein each of the leg segments of the at least one silo hopper is structurally connected to a respective octagonal bushing.

* * * * *